US006463239B1

(12) United States Patent
Hays et al.

(10) Patent No.: US 6,463,239 B1
(45) Date of Patent: Oct. 8, 2002

(54) ELECTROPHOTOGRAPHIC DEVELOPMENT SYSTEM WITH CUSTOM COLOR PRINTING

(75) Inventors: Dan A. Hays, Fairport; Jack T. LeStrange, Macedon, both of NY (US)

(73) Assignee: Xerox Corporation, Stamford, CT (US)

( * ) Notice: Subject to any disclaimer, the term of this patent is extended or adjusted under 35 U.S.C. 154(b) by 59 days.

(21) Appl. No.: 09/723,789

(22) Filed: Nov. 28, 2000

(51) Int. Cl.[7] ..... G03G 15/06
(52) U.S. Cl. ..... 399/222; 399/281; 399/285
(58) Field of Search ..... 399/53, 222, 223, 399/231, 232, 274, 281, 285, 265, 266; 430/42, 45, 120

(56) References Cited

U.S. PATENT DOCUMENTS 4,614,419 A * 9/1986 Patz ..... 399/274
5,039,598 A 8/1991 Abramsohn et al. ..... 430/347
5,121,172 A * 6/1992 Stover ..... 399/232
5,708,950 A * 1/1998 Badesha ..... 399/333

* cited by examiner

*Primary Examiner*—Sophia S. Chen
*Assistant Examiner*—Hoan Tran
(74) *Attorney, Agent, or Firm*—Lloyd F. Bean, II

(57) ABSTRACT

An apparatus for developing a latent image recorded on an imaging surface, including: a first developer unit for developing a portion of the latent image with a toner of custom color, the first developer unit including a housing defining a reservoir for storing a supply of developer material including conductive toner; a dispenser for dispensing toner of a first color and toner of a second color into the housing, the dispenser including device for mixing toner of the first color and toner of the second color together to form toner of the custom color; a donor member for transporting toner of the custom color on an outer surface of the donor member to a development zone; device for loading a toner layer of the custom color onto the outer surface of the donor member; and device for inductive charging the toner layer onto the outer surface of the donor member prior to the development zone to a predefine charge level; and a second developer unit for developing a remaining portion of the latent image with toner being substantial different than the toner of the custom color.

4 Claims, 4 Drawing Sheets

FIG. 3
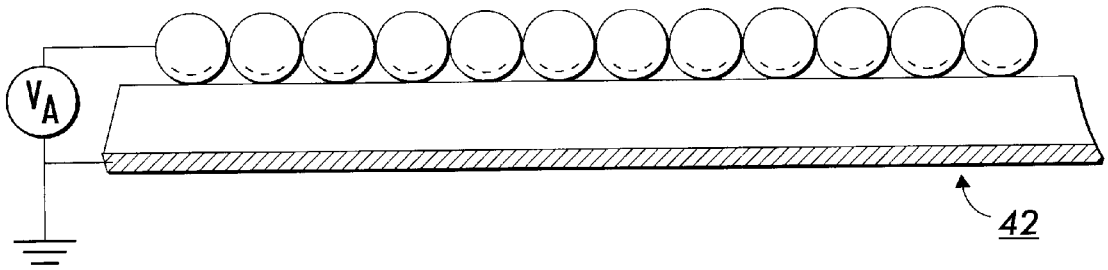
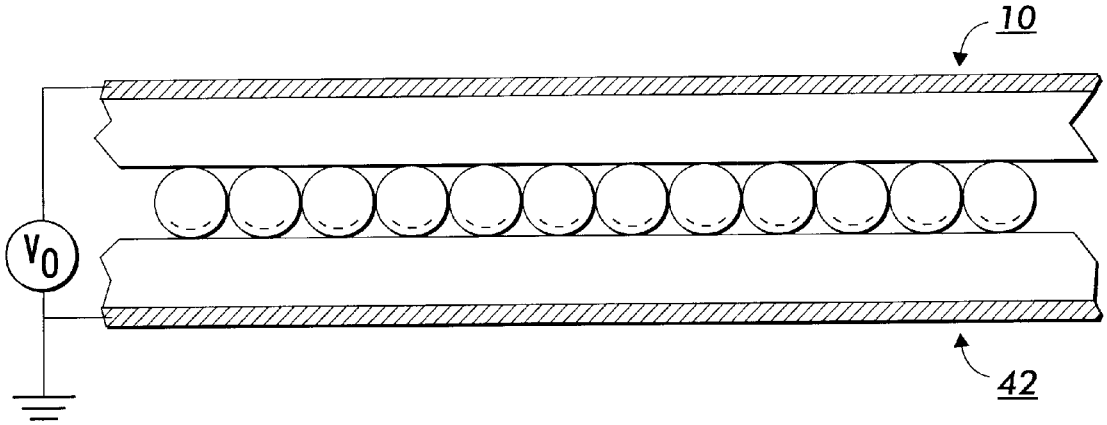
FIG. 4

ELECTROPHOTOGRAPHIC DEVELOPMENT SYSTEM WITH CUSTOM COLOR PRINTING

Cross reference is made to the following applications filed concurrently herewith; U.S. application Ser. No. 09/723,561 entitled "Electrophotographic Development System With Induction Charged Toner", U.S. application Ser. No. 09/723,934 entitled "Electrophotographic Development System With Induction Charged Toner", U.S. application Ser. No. 09/723,778 entitled "Ballistic Aerosol Marking Process Employing Marking Material Comprising Vinyl Resin and Poly(3,4-ethylenedioxythiophene)", U.S. application Ser. No. 09/723,577 entitled "Ballistic Aerosol Marking Process Employing Marking Material Comprising Vinyl Resin and Poly(3,4-ethylenedioxypyrrole)", U.S. application Ser. No. 09/724,458 entitled "Toner Compositions Comprising Polythiophenes", U.S. application Ser. No. 09/723,839 entitled "Toner Compositions Comprising Polypyrroles", U.S. application Ser. No. 09/723,787 entitled "Ballistic Aerosol Marking Process Employing Marking Material Comprising Polyester Resin and Poly(3,4-ethylenedioxythiophene)", U.S. application Ser. No. 09/723,834 entitled "Ballistic Aerosol Marking Process Employing Marking Material Comprising Polyester Resin and Poly(3,4-ethylenedioxypyrrole)", U.S. application Ser. No. 09/724,064 entitled "Toner Compositions Comprising Polyester Resin and Poly(3,4-ethylenedioxythiophene)", U.S. application Ser. No. 09/723,851 entitled "Toner Compositions Comprising Vinyl Resin and Poly(3,4-ethylenedioxypyrrole)", U.S. application Ser. No. 09/723,907 entitled "Toner Compositions Comprising Polyester Resin and Poly(3,4-ethylenedioxypyrrole)", U.S. application Ser. No. 091724,013 entitled "Toner Compositions Comprising Vinyl Resin and Poly(3,4-ethylenedioxythiophene)", U.S. application Ser. No. 09/723,654 entitled "Process For Controlling Triboelectric Charging", and U.S. application Ser. No. 09/723,911 entitled "Toner Compositions Comprising Polyester Resin and Polypyrrole".

BACKGROUND OF THE INVENTION

This invention relates generally to a development apparatus for ionographic or electrophotographic imaging and printing apparatuses and machines, and more particularly is directed to a single component development system wherein a donor roll or belt is loaded with inductively charged toner particles, in which the toner particles are subsequently transferred to a latent image.

Generally, the process of electrophotographic printing includes charging a photoconductive member to a substantially uniform potential so as to sensitize the surface thereof. The charged portion of the photoconductive surface is exposed to a light image from either a scanning laser beam, an LED array, or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two components, in which the developer material is comprised of magnetic carrier granules having toner particles adhering triboelectrically thereto and a single component, which typically uses toner only. Toner particles are attracted to the latent image forming a toner powder image on the photoconductive surface. The toner powder image is subsequently transferred to an intermediate or a copy sheet, and finally, the toner powder image is heated to permanently fuse it to the copy sheet in image configuration. The operating latitude of a powder xerographic development system is determined to a great degree by the ease with which toner particles are supplied to an electrostatic image. Placing charge on the particles, to enable movement and imagewise development via electric fields, is most often accomplished with triboelectricity.

The triboelectric charging is obtained by either mixing the toner with larger carrier beads in a two component development system or by rubbing the toner between a blade and donor roll in a single component system.

However, all development systems which use triboelectricity to charge toner, whether they be two component (toner and carrier) or single component (toner only), have one feature in common: charges are distributed non-uniformly on the surface of the toner. This results in high electrostatic adhesion due to localized high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, triboelectric charged particles much more difficult to develop and control.

Although such powder development systems have served the electrophotographic industry well over the years, there continues to be a need for improvements in toner charging since triboelectricity is not well understood and unpredictable results occur due to a strong materials sensitivity. For example, the materials sensitivity causes difficulties in identifying a triboelectrically compatible set of color toners that can be blended for custom colors. Furthermore, to enable "offset" print quality with powder-based electrophotographic development systems, small toner (~5 $\mu$m diameter) is desired. Although the functionality of small, triboelectrically charged toner has been demonstrated, concerns remain regarding the long-term stability and reliability of such systems.

Given that charged particle adhesion is a major limiting factor in development with dry powder, it has been a goal to identify toner charging and delivery schemes which keep toner adhesion low.

Convention single component development (SCD) systems based on induction charging within the development zone utilize a magnetic loaded toner to suppress background deposition. If with such SCD systems one attempts to suppress background deposition by using an electric field of polarity opposite to that of the image electric field (as practiced with practiced with electrophotographic systems that use a triboelectric toner charging development system), toner of opposite polarity to the image toner will be induction charged and deposited in the background regions. To circumvent this problem, the electric field in the background regions must be set to near zero. To prevent deposition of uncharged toner in the background regions, a magnetic material is included in the toner so that a magnetic force can be applied by the incorporation of magnets inside the development roll. However, the addition of magnetic material in the toner precludes bright colors since the material absorbs visible light.

SUMMARY OF THE INVENTION

An object of the present invention is to circumvent limitations associated with development systems based on triboelectrically charged toner. A non-triboelectric toner charging system is desired to enable a more stable development system with greater latitude in toner materials; and to circumvent limitations associated with conventional single component development (SCD) systems based on induction charging within the development zone.

More specifically, it is an object of the invention to describe a single component development system based on the induction charging of conductive, nonmagnetic toner prior to the development zone. The nonmagnetic toner enables bright colors for process and custom colors.

There is provided an apparatus for developing a latent image recorded on an imaging surface, including: a first developer unit for developing a portion of said latent image with a toner of custom color, said first developer including a housing defining a reservoir for storing a supply of developer material comprising conductive toner; a dispenser for dispensing toner of a first color and toner of a second color into said housing, said dispenser including means for mixing toner of said first color and toner of said second color together to form toner of said custom color; a donor member for transporting toner of said custom color on an outer surface of said donor member to a development zone; means for loading a toner layer of said custom color onto said outer surface of said donor member; and means for inductive charging said toner layer onto said outer surface of said donor member prior to the development zone to a predefine charge level; and a second developer unit for developing a remaining portion of said latent image with toner being substantial different than said toner of said custom color.

BRIEF DESCRIPTION OF THE FIGURES

FIG. 3 illustrates a monolayer of induction charged toner on a dielectric overcoated substrate.

FIG. 4 illustrates a monolayer of previously induction charged toner between donor and receiver dielectric overcoated substrates.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
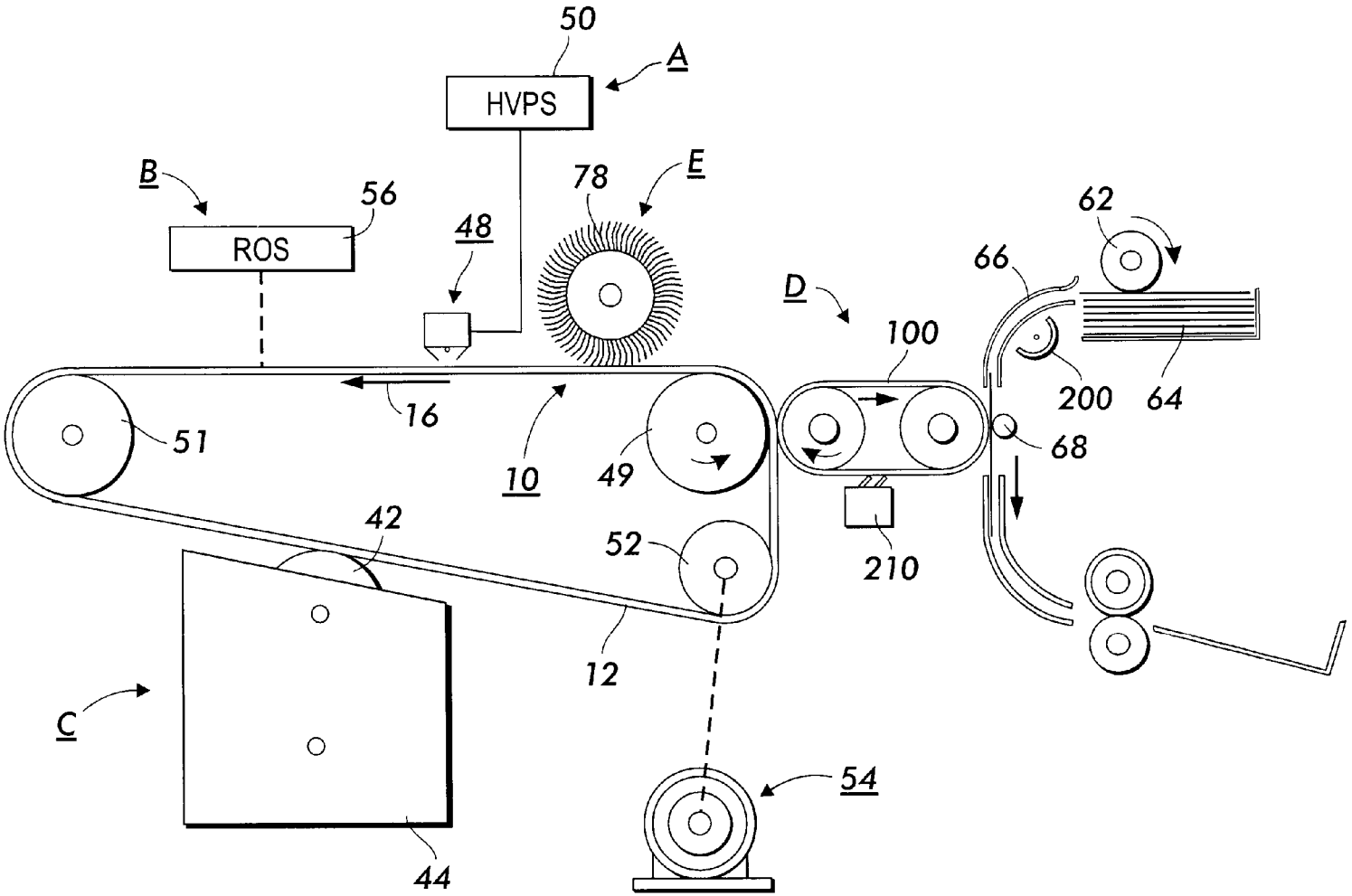
FIG. 1 is a schematic elevational view of an illustrative electrophotographic printing machine incorporating the present invention therein.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12 deposited on a substrate. The substrate is preferably made from a polyester film such as Mylar (trademark of Dupont) which has been coated with a thin conductive layer that is electrically grounded. The belt is driven by means of motor 54 along a path defined by rollers 49, 51 and 52, the direction of movement being counter-clockwise as viewed and as shown by arrow 16. Initially a portion of the belt 10 passes through a charge station A at which a corona generator 48 charges surface 12 to a relatively high, substantially uniform, potential. A high voltage power supply 50 is coupled to device 48.

Next, the charged portion of photoconductive surface 12 is advanced through exposure station B. At exposure station B, a Raster Output Scanner (ROS) 56 scans the photoconductive surface in a series of scan lines perpendicular to the process direction. Each scan line has a specified number of pixels per inch. The ROS includes a laser with a rotating polygon mirror to provide the scanning perpendicular to the process direction. The ROS imagewise exposes the charged photoconductive surface 12.

After the electrostatic latent image has been recorded on photoconductive surface 12, belt 10 advances the latent electrostatic image to development station C as shown in FIG. 1. At development station C, a development system or developer unit 44, develops the latent image recorded on the photoconductive surface. The chamber in the developer housing stores a supply of developer material. The developer material is a single component developer material consisting of nonmagnetic, conductive toner that is induction charged on a dielectric overcoated donor roll prior to the development zone. The developer material may be a custom color consisting of two or more different colored dry powder toners.

Again referring to FIG. 1, after the electrostatic latent image has been developed, belt 10 advances the developed image to transfer station D, at which, the developed image is tack transferred to a heated transfuse belt or roll 100. The covering on the compliant belt or drum typically consists of a thick (1.3 mm) soft (IRHD hardness of ~40) silicone rubber. (Thinner and harder rubber provide tradeoffs in latitudes. The rubber can also have a thin Viton (trademark of Dupont) top coat for improved reliability.) If the transfuse belt or roll is maintained at a temperature near 120° C., tack transfer of the toner from the photoreceptor to the transfuse belt or drum can be obtained with a nip pressure of ~50 psi. As the toned image advances from the photoreceptor transfuse belt nip to the transfuse belt-media transfuse nip, the toner is softened by the ~120° C. transfuse belt temperature. With the sheet (paper) 64 preheated to ~85° C. in guides 66 by a heater 200, as sheet 64 is advanced by roll 62 and guides 66 into contact with the developed image on roll 100 transfuse of the image to the media is obtained with a nip pressure of ~100 psi. It should be noted that the toner release from the roll 100 can be aided by a small amount of silicone oil that is imbibed in the roll for toner release at the toner/roll interface. The bulk of the compliant silicone material also contains a conductive carbon black to dissipate any charge accumulation. As noted in FIG. 1, a cleaner 210 for the transfuse belt material is provided to remove residual toner and fiber debris. An optional glossing station (not shown) can be employed by the customer to select a desired image gloss level.

After the developed image is separated from photoconductive surface 12 of belt 10, the residual developer material adhering to photoconductive surface 12 is removed therefrom by a rotating fibrous brush 78 at cleaning station E in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
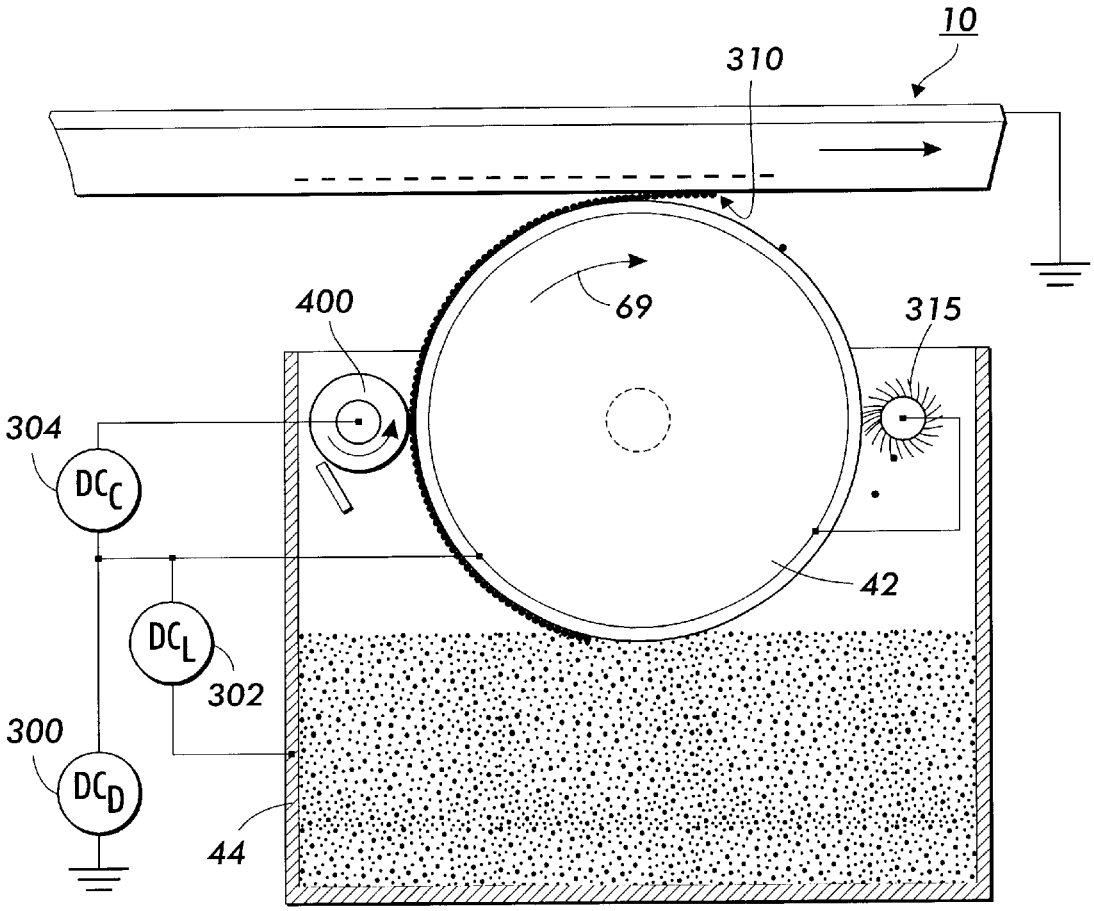
FIG. 2 is a schematic illustration of the development system according to the present invention.

Referring now to FIG. 2, as the donor 42 rotates in the direction of arrow 69, a voltage $DC_D$ 300 is applied to the donor roll to electrostatically transfer the desired polarity of toner to the belt 10 while at the same time preventing toner transfer in the non-image areas of the imaged belt 10. Donor roll 42 is mounted, at least partially, in the chamber of developer housing 44 containing nonmagnetic, conductive toner. The chamber in developer housing 44 stores a supply of the toner that is in contact with donor roll 42. Donor roll 42 consist of a conductive aluminum core overcoated with a thin (50 $\mu$m) dielectric insulating layer. A voltage $DC_L$ 302 applied between the developer housing 44 and the donor roll 42 causes induction charging and loading of the nonmagnetic, conductive toner onto the dielectric overcoated donor roll.

Toner used in the present invention comprises toner particles that are relative conductive, with average bulk conductivity values typically of no less than about 10 Siemens per centimeter, and preferably no less than about 1 Siemens per centimeter, and with particle conductivity values typically no less than about 10–11 Siemens per centimeter, and preferably no less than about 10–7 Siemens per centimeter, although the conductivity values can be outside of these ranges. "Average bulk conductivity" refers to the ability for electrical charge to pass through a pellet of toner particles placed between two electrodes. Examples of suitable conductive toners include those having either dispersed within the toner particles or coated as a shell on the particles a poly(3,4-ethylenedioxythiophene) or poly(3,4-ethylenedioxypyrrole), preferably in the oxidized form, and doped with a dopant such as sulfonate, phosphate, or phosphonate moieties, iodine, or the like, as disclosed in Copending application Ser. No. 09/724,458, Copending application Ser. No. 09/724,064, Copending application Ser. No. 09/723,851, Copending application Ser. No. 09/723,907, and Copending application Ser. No. 09/724,013, the disclosures of each of which are totally incorporated herein by reference. The polymer can be formed by oxidative polymerization of the monomer in the presence of an oxidizing agent. The particle conductivity can be adjusted by various synthetic parameters of the polymerization: reaction time, molar ratios of oxidant and dopant to 3,4-ethylenedioxythiophene or 3,4-ethylenedioxypyrrole monomer, temperature, and the like. Additional examples of toner that can be employed in the present invention include insulative magnetic or nonmagnetic toner for which small inorganic or organic conductive particles are deposited and/or embedded on the surface of the toner to render the toner powder conducting. Examples of inorganic surface additives include tin oxide, indium-doped tin oxide, antimony-doped tin oxide, fluorine-doped tin oxide and copper iodide. Examples of organic surface additives include any of a wide variety of intrinsically conductive polymers.

As successive electrostatic latent images are developed, the toner particles within the developer housing 44 are depleted to an undesirable level. A toner dispenser (not shown) stores a supply of toner particles. The toner dispenser is in communication with housing 44. As the level of toner particles in the chamber is decreased, fresh toner particles are furnished from the toner dispenser.

The maximum loading of induction charged, conductive toner onto the dielectric overcoated donor roll 42 is limited to approximately a monolayer of toner. For a voltage $DC_L$ 302 greater than approximately 100 volts, the monolayer loading is essentially independent of bias level. However, the charge induced on the toner monolayer is proportional to the voltage $DC_L$ 302. This implies that the charge-to-mass ratio of the toner loaded on donor roll 42 can be controlled according to the voltage $DC_L$ 302. As an example, if a DCL voltage of −200 volts is applied to load conductive toner onto donor roll 42 with a dielectric overcoating thickness of 25 $\mu$m, the toner charge-to-mass ratio is −17 $\mu$C/g.

As the toned donor rotates in the direction indicated by arrow 69 in FIG. 2, it is desired to condition the toner layer on the donor roll 42 before the development zone 310. The objective of the toner layer conditioning device is to remove any toner in excess of a monolayer. Without the toner layer conditioning device, toner-toner contacts in the development zone can cause wrong-sign toner generation and deposition in the non-image areas. A toner layer conditioning device 400 is illustrated in FIG. 2. This particular example uses a compliant overcoated roll that is biased at a voltage $DC_C$ 304. The overcoating material is charge relaxable to enable dissipation of any charge accumulation. The voltage $DC_C$ 304 is set at a higher magnitude than the voltage $DC_L$ 302. For synchronous contact between the donor roll 42 and conditioning roll 400 under the bias voltage conditions, any toner on donor roll 42 that is on top of toner in the layer is induction charged with opposite polarity and deposited on the roll 400. A doctor blade on conditioning roll 400 continually removes the deposited toner.

As donor 42 is rotated further in the direction indicated by arrow 69, the now induction charged and conditioned toner layer is moved into development zone 310, defined by a synchronous contact between donor 42 and the photoreceptor belt 10. In the image areas, the toner layer on the donor roll is developed onto the photoreceptor by electric fields created by the latent image. In the non-image areas, the electric fields prevent toner deposition. Since the adhesion of induction charged, conductive toner is typically less than that of triboelectrically charged toner, only DC electric fields are required to develop the latent electrostatic image in the development zone. The DC field is provided by both the DC voltages $DC_D$ 300 and $DC_L$ 302, and the electrostatic potentials of the latent image on photoconductor 10.

Since the donor roll 42 is overcoated with a highly insulative material, undesired charge can accumulate on the overcoating surface over extended development system operation. To eliminate any charge accumulation, a charge neutralizing device may be employed. One example of such device is illustrated in FIG. 2 whereby a rotating electrostatic brush 315 is brought into contact with the toned donor roll. The voltage on the brush 315 is set at or near the voltage applied to the core of donor roll 42.

An advantageous feature of the present invention is that the precharging of conductive, nonmagnetic toner prior to the development zone enables the application of an electrostatic force in the development zone for the prevention of background toner and the deposition of toner in the image areas. Background control and image development with an induction charged, nonmagnetic toner requires a process for forming a monolayer of toner that is brought into contact with an electrostatic image. Monolayer toner coverage is sufficient in providing adequate image optical density if the coverage is uniform. Monolayer coverage with small toner enables thin images desired for high image quality.

To understand how toner charge is controlled with the present invention, FIG. 3 illustrates a monolayer of induction charged toner on a dielectric overcoated substrate 42. The monolayer of toner is deposited on the substrate when a voltage $V_A$ is applied to conductive toner. The average charge density on the monolayer of induction charged toner is given by the formula $$\sigma = \frac{V_A \varepsilon_0}{(T_d/\kappa_d + 0.32R_p)} \tag{1}$$

where $T_d$ is the thickness of the dielectric layer, $\kappa_d$ is the dielectric constant, $R_p$ is the particle radius and $\epsilon_o$ is the permittivity of free space. The $0.32R_p$ term (obtained from empirical studies) describes the average dielectric thickness of the air space between the monolayer of conductive particles and the insulative layer.

For a 25 $\mu$m thick dielectric layer ($\kappa_d$=3.2), toner radius of 6.5 $\mu$m and applied voltage of −200 volts, the calculated surface charge density is −18 nC/cm$^2$. Since the toner mass density for a square lattice of 13 $\mu$m nonmagnetic toner is ~0.75 mg/ cm$^2$, the toner charge-to-mass ratio is ~−17 $\mu$C/g. Since the toner charge level is controlled by the induction charging voltage and the thickness of the dielectric layer, one can expect the toner charging will not depend on other factors such as the toner pigment, flow additives, relative humidity, etc.

With an induction charged layer of toner formed on a donor roll or belt, the charged layer can be brought into contact with an electrostatic image on a dielectric receiver. FIG. 4 illustrates an idealized situation where a monolayer of previously induction charged conductive spheres is sandwiched between donor 42 and receiver dielectric materials 10.

The force per unit area acting on induction charged toner in the presence of an applied field from a voltage difference, $V_o$, between the donor and receiver conductive substrates is given by the equation;

$$F/A = -\frac{\sigma^2}{2\varepsilon_0}\left(\frac{T_r/\kappa_r + T_a^r - T_d/\kappa_d - T_a^d}{T_r/\kappa_r + T_d/\kappa_d + T_a^r + T_a^d}\right) + \frac{\sigma V_0}{T_r/\kappa_r + T_d/\kappa_d + T_a^r + T_a^d} - (F_{sr}^d - F_{sr}^r) \tag{2}$$

where $\sigma$ is the average charge density on the monolayer of induction charged toner (described by Eq. 1), $T_r/\kappa_r$ and $T^{d/\kappa}{}_d$ are the dielectric thicknesses of the receiver and donor, respectively, $T^r{}_a$ and $T^d{}_a$ are the average thicknesses of the receiver and donor air gaps, respectively, $V_o$ is the applied potential, $T_a$=0.32 $R_p$ where $R_p$ is the particle radius, $\epsilon_o$ is the permittivity of free space and $F^r{}_{sr}$ and $F^d{}_{sr}$ are the short-range force per unit area at the receiver and donor interfaces, respectively. The first term due to an electrostatic image force from neighboring particles becomes zero when the dielectric thicknesses of the receiver and its air gap are equal to the dielectric thicknesses of the donor and its air gap. Under these conditions, the threshold applied voltage for transferring toner to the receiver should be zero if the difference in the receiver and donor short-range forces is negligible. However, one expects a distribution in the short-range forces.

To illustrate the functionality of present invention, the developer system of FIG. 2 was tested under the following conditions. A sump of toner (conducting toner of 13 $\mu$m volume average particle size) biased at a potential of −200 volts was placed in contact with a 25 $\mu$m thick Mylar (grounded aluminum on backside) donor belt moving at a speed of 4.2 inches per sec. To condition the toner layer and to remove any loosely adhering toner, a 25 $\mu$m thick Mylar covered aluminum roll was biased at a potential of −300 volts and contacted with the toned donor belt at substantially the same speed as the donor belt. This step was repeated a second time. The conditioned toner layer was then contacted to an electrostatic image moving at substantially the same speed as the toned donor belt. The electrostatic image had a potential of −650 volts in the non-image areas and −200 volts in the image areas. A DC potential of +400 volts was applied to the substrate of the electrostatic image bearing member during synchronous contact development. A toned image with adequate optical density and low background was observed.

In summary, the present invention based on induction charging of conductive toner prior to the development zone offers a number of advantages compared to electrophotographic development systems based on triboelectric charging of insulative toner. The toner charging with the proposed system only depends on the induction charging bias provided the toner conductivity is sufficiently high. Thus, the charging is insensitive to toner materials such as the pigment and resin types. Furthermore, the performance should not depend on the environmental conditions such as relative humidity.

The present invention also can be used in an electrographic printing system for printing black plus one or several separate custom colors with a wide color gamut obtained by blending multiple conductive, nonmagnetic color toners in a single component development system. The induction charging of conductive toner blends is pigment-independent. Each electrostatic image is formed with either ion or Electron Beam Imaging (EBI) and developed on separate electroreceptors. The images are tack transferred image-next-to-image onto a transfuse belt or drum for subsequent heat and pressure transfuse to a wide variety of media. The custom color toners including metallics are obtained by blending different combinations and percentages of toners from a set of nine primariy toners plus transparent and black toners to control the lightness or darkness of the custom color. The blending of the toners can be done either outside of the electrophotographic printing system or within the system in which case the different proportions of color toners are directly added to the in-situ toner dispenser.

Figure 5:
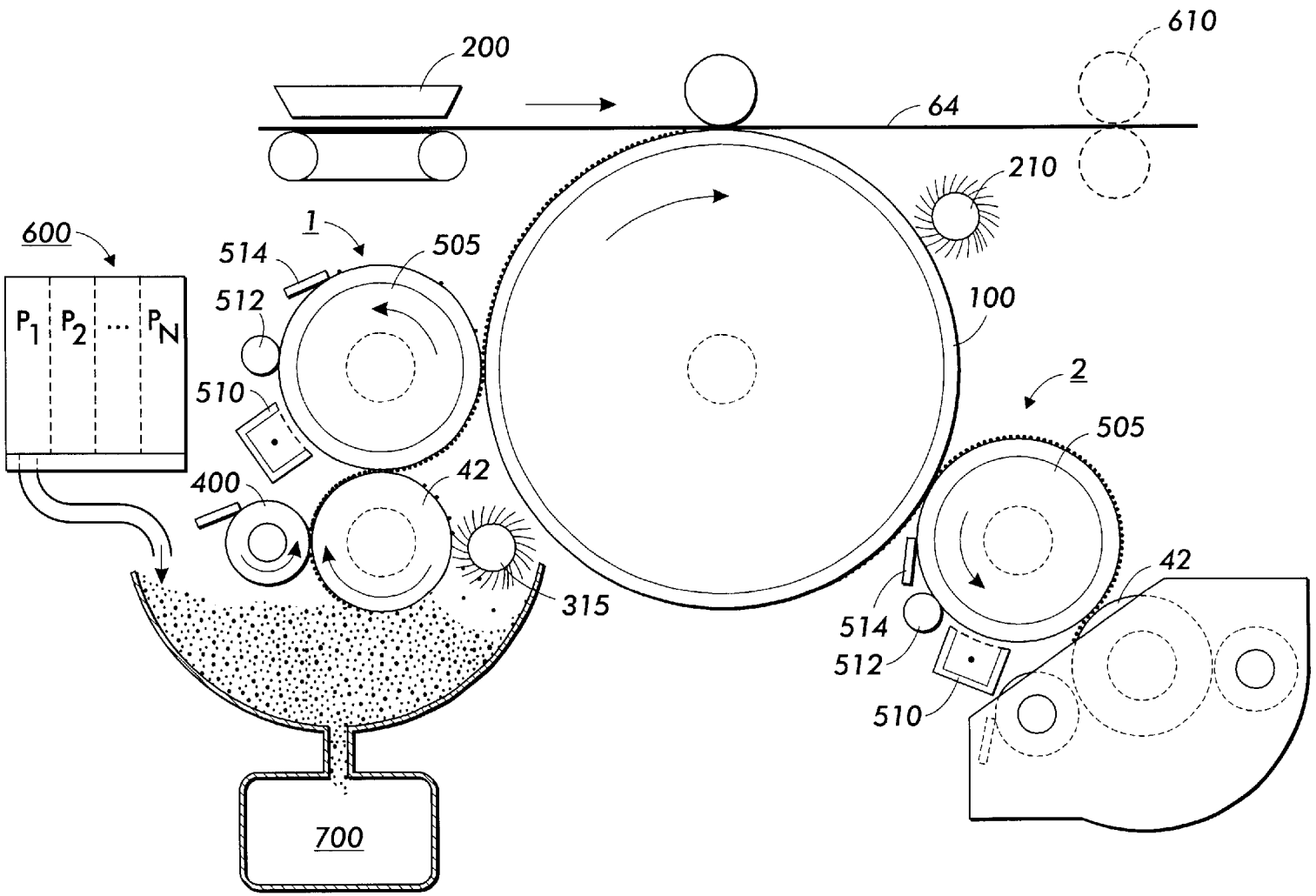
FIG. 5 is a schematic elevational view of an illustrative electrophotographic printing machine incorporating the present invention therein for the printing of black and a custom color.

FIG. 5 illustrates the components and architecture of the proposed system for custom color printing. The figure illustrates two electroreceptor modules although it is understood that additional modules could be included for the printing of multiple custom colors on a document. For discussion purposes, we assume that the second module 2 prints black toner. The electroreceptor module 2 uses a nonmagnetic, conductive toner single component development (SCD) system that has been described in FIG. 2. However, a conventional SCD system that uses magnetic, conductive toner that is induction charged by the electrostatic image on the electroreceptor can also be used to print the black toner.

For the electroreceptor module 1 for the printing of custom color, an electrostatic image is formed on an electroreceptor drum 505 with either ion or Electron Beam Imaging device 510 as taught in U.S. Pat. No. 5,039,598 which is hereby incorporated by reference. The nonmagnetic, single component development system contains a blend of nonmagnetic, conductive toners to produce a desired custom color. An insulative overcoated donor 42 is loaded with the induction charged blend of toners. A toner layer conditioning station 400 helps to ensure a monolayer of induction charged toner on the donor. (Monolayer toner coverage is sufficient provide adequate image optical density if the coverage is uniform. Monolayer coverage with small toner enables thin images desired for high image quality.) The monolayer of induction charged toner on the donor is brought into synchronous contact with the imaged electroreceptor 505. (The development system assembly can be cammed in and out so that it is only in contact with warmer electroreceptor during copying/printing.) The precharged toner enables the application of an electrostatic force in the development zone for the prevention of background toner and the deposition of toner in the image areas. The toned image on the electroreceptor is tack transferred to the heated transfuse member 100 which can be a belt or drum. The covering on the compliant transfuse belt or drum typically consists of a thick (1.3 mm) soft (IRHD hardness of –40) silicone rubber. Thinner and harder rubber provide tradeoffs in latitudes. The rubber can also have a thin Viton top coat for improved reliability. It the transfuse belt/drum is maintained at a temperature near 120° C., tack transfer of the toner from the electroreceptor to the transfuse belt/drum can be obtained with a nip pressure of ~50 psi. As the toned image advances from the electroreceptor-transfuse drum nip for each module to the transfuse drum-media transfuse nip, the toner is softened by the ~120° C. transfuse belt temperature. With the media (paper) preheated to ~85° C., transfuse of the image to the media is obtained with a nip pressure of ~100 psi. It should be noted that the toner release from the silicone belt is aided by a small amount of silicone oil that is imbibed in the belt for toner release at the toner/belt interface. The bulk of the compliant silicone material also contains a conductive carbon black to dissipate any charge accumulation. As noted in FIG. 5, a cleaner 210 for the transfuse drum material is provided to remove residual toner and fiber debris. An optional glossing station 610 enables the customer to select a desired image gloss level. The electroreceptor cleaner 514 and erase bar 512 are provided to prepare for the next imaging cycle.

The proposed black plus custom color(s) printing system enables improved image quality through the use of smaller toner (3 to 10 $\mu$m) such as Emulsion Aggregated (EA) chemical toner. The utilization of EA toner in the proposed system should be advantages since the EA toner manufacturing process requires a number (~5) water washings to render the toner sufficiently insulating for triboelectric toner charging systems. Since the proposed SCD system requires conducting toner, an EA process for producing conductive toner requires fewer washings with the benefit of lower cost and reduced processing time. To provide sufficient toner flowability (low toner cohesion), it is anticipated that a conducting surface additive such as flourine-doped tin oxide is required. Since the particle size of such additives is comparable to flow-agents presently used for insulative toners, it is anticipated that one can achieve good toner flow properties with a conductive surface additive.

The SCD system for module 1 shown in FIG. 5 inherently can have a small sump of toner. This is advantageous in switching the custom color to be used in the SCD system. The bulk of the blended toner can be returned to a supply bottle of the particular blend. The residual toner in the housing can be removed by vacuuming 700. SCD systems are advantaged compared to two-component developer systems since the toner must be separated from the carrier beads if the same beads are to be used for the new custom color blend.

A particular custom color can be produced by off line equipment that blends a number of toners selected from a set of nine primary color toners (plus transparent and black toners) that enable a wide custom color gamut, such as Pantone® colors. A process for selecting proportional amounts of the primary toners for in-situ addition to a SCD housing can be provided by dispenser 600. The color is controlled by the relative weights of primaries. The P1 . . . Pn primaries can be selected to dispense toner into a toner bottle for feeding toner to a SCD housing in the machine or directly dispense to the sump of the SCD system on a periodic basis according to the amount needed based on the run length and area coverage can be contained by the sump. The dispensed toners are tumbled/agitated to blend the primary toners prior to use. In addition to the nine primary color toners for formulating a wide color gamut, one can also use metallic toners (which tend to be conducting and therefore compatible with the SCD process) which are desired for greeting, invitation and name card applications. Custom color blends of toner can be made in an off line (paint shop) batch process, one can also arrange to have a set of primary color toners continuously feeding a sump of toner within (in-situ) the printer. This enables a dial-a-color system provided an in-situ toner waste system is provided for color switching.

An electrographic printing system is proposed that prints black plus one or several separate custom colors with a wide color gamut obtained by blending conductive, nonmagnetic toner in a single component development system. The induction charging of conductive toner blends is pigment-independent. The image for each color is developed on a separate electroreceptor and tack transferred image-next-to-image on a transfuse belt or drum. The assembled black plus custom color(s) image is then heat and pressure transfused to a wide variety of media. Custom colors including metallics are obtained by blending up to nine primaries in either an off line (paint shop) or in-situ process.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a first developer unit for developing a portion of said latent image with a toner of a custom color, said first developer unit including a housing defining a reservoir for storing a supply of toner; a dispenser for dispensing toner of a first color and toner of a second color into said housing, said dispenser including means for mixing toner of said first color and toner of said second color together to form toner of said custom color; a donor member for transporting toner of said custom color on an outer surface of said donor member to a development zone; means for loading a toner layer of said custom color onto said outer surface of said donor member; and means for inductive charging said toner layer onto said outer surface of said donor member prior to the development zone to a predefine charge level; and a second developer unit for developing a remaining portion of said latent image with toner being substantial different than said toner of said custom color.

2. The apparatus as recited in claim 1, further including means for removing toner from said reservoir.

3. The apparatus of claim 1, wherein said toner is conductive.

4. A method of forming toner images, said method including the steps of:

forming spot next to spot toner images by placing spots of toner of a first color next to spots of toner of a second color on an imaging member; mixing toner of a third color and toner of said second color to produce said toner of said first color, said forming step includes the step of inductive charging toner of said first color; and said second color; and transferring said spot next to spot toner images on from said imaging member to an intermediate imaging member.

* * * * *